US011745075B2

(12) United States Patent
Jeon et al.

(10) Patent No.: US 11,745,075 B2
(45) Date of Patent: Sep. 5, 2023

(54) DIVIDED DRIVING SWING PLATFORM

(71) Applicant: GOLFZON CO., LTD., Seoul (KR)

(72) Inventors: Gwang Seok Jeon, Daejeon (KR); Jung Hun Lee, Sejong-si (KR)

(73) Assignee: GOLFZON CO., LTD., Seoul (KR)

( * ) Notice: Subject to any disclaimer, the term of this patent is extended or adjusted under 35 U.S.C. 154(b) by 0 days.

(21) Appl. No.: 17/795,865

(22) PCT Filed: Feb. 2, 2021

(86) PCT No.: PCT/KR2021/001328
§ 371 (c)(1),
(2) Date: Jul. 27, 2022

(87) PCT Pub. No.: WO2021/162312
PCT Pub. Date: Aug. 19, 2021

(65) Prior Publication Data

US 2023/0074768 A1 Mar. 9, 2023

(30) Foreign Application Priority Data

Feb. 11, 2020 (KR) ..... 10-2020-0016589

(51) Int. Cl.
*A63B 69/36* (2006.01)
*A63B 67/02* (2006.01)

(52) U.S. Cl.
CPC ..... *A63B 69/3661* (2013.01); *A63B 67/02* (2013.01); *A63B 2067/025* (2013.01); *A63B 2225/09* (2013.01)

(58) Field of Classification Search
CPC ..... A63B 69/3661; A63B 67/02; A63B 2067/025; A63B 2225/09
USPC ..... 473/278, 279
See application file for complete search history.

(56) References Cited

U.S. PATENT DOCUMENTS 5,431,406 A * 7/1995 Ishii ..... A63B 69/3652 473/279
9,011,264 B2 * 4/2015 Tang ..... A63B 69/3661 473/278
2002/0128084 A1 * 9/2002 Lee ..... A63B 57/0006 473/134
2005/0113182 A1 * 5/2005 Kim ..... A63B 69/3652 473/279

FOREIGN PATENT DOCUMENTS

KR 10-0912015 B1 8/2009
KR 10-2013-0015205 A 2/2013
(Continued)

OTHER PUBLICATIONS

International Search Report for PCT/KR2021/001328 dated May 20, 2021 from Korean Intellectual Property Office.

*Primary Examiner* — Nini F Legesse
(74) *Attorney, Agent, or Firm* — Revolution IP, PLLC

(57) ABSTRACT

The present invention is to provide a divided driving swing platform including a plurality of plates divided from the swing platform on which a user can perform a golf swing with a golf club and operated stably by increasing a degree of freedom of movement of each of the divided plates so that each of the divided plates can move in various ways and interference between the divided plates does not occur when each of the divided plates is driven and operated.

9 Claims, 9 Drawing Sheets

(56) References Cited

FOREIGN PATENT DOCUMENTS

| | | | |
|---|---|---|---|
| KR | 10-1422073 | B1 | 7/2014 |
| KR | 10-1434518 | B1 | 8/2014 |
| KR | 10-1495308 | B1 | 2/2015 |
| KR | 10-1562174 | B1 | 10/2015 |
| KR | 10-2015-0132951 | A | 11/2015 |
| KR | 10-2017-0072097 | A | 6/2017 |
| WO | WO-2017030239 | A1 * | 2/2017 |

* cited by examiner (a)

(b)

DIVIDED DRIVING SWING PLATFORM

TECHNICAL FIELD

The present invention relates to a divided driving swing platform, and more particularly, to a swing platform on which a user performs a golf swing with a golf club in golf practice or screen golf using a virtual golf simulation device.

BACKGROUND ART

Generally, in golf courses, users may simply take golf shots on flat ground, but they often take golf shots under various topographical conditions such as downhill slopes, uphill slopes, gentle slopes, steep slopes, and recessed terrain.

In this way, a swing plate is provided as a batter's box for the user to take a golf shot in various terrain conditions as well as a golf shot on flat ground. The swing plate forms an inclination at an arbitrary angle, and the user takes a golf shot on the inclined swing plate so that the user can practice golf shot under various topographic conditions.

The conventional swing plate as described above has a configuration in which a single plate member may be inclined at various angles by a motor.

As a prior art document related to this, prior art such as Korean Patent No. 0912015 and Korean Patent No. 1422073 are disclosed.

However, the swing plate, which simply tilts a single plate member in one direction, has a limit in allowing the user to practice golf shots under various terrain conditions. In order to solve this problem, a technology has been disclosed in which a swing plate is divided into a plurality of unit plates rather than a single plate member, and each of the divided unit plates is driven to realize various topographic conditions.

As such a prior art document, prior technologies such as Korean Patent Registration No. 1696667, Korean Patent Registration No. 1495308, and Korean Patent Registration No. 1562174 are disclosed.

However, since the conventional swing plate (which has a plurality of unit plates as shown above) causes interference between the unit plates when each unit plate is driven and moved, the range in which each unit plate can move is limited. In addition, since a plurality of vertical driving motors are driven in contact with each unit plate, the life and durability of the product are weak, such as wear of the contact part during use.

DISCLOSURE

Technical Problem

An object of the present invention is to provide a divided and driving swing platform including a plurality of plates divided from the swing platform on which a user can perform a golf swing with a golf club and operated stably by increasing a degree of freedom of movement of each of the divided plates so that each of the divided plates can move in various ways and interference between the divided plates does not occur when each of the divided plates is driven and operated.

Technical Solution

In accordance with an aspect of the present invention, the above and other objects can be accomplished by the provision of a divided driving swing platform providing a swing stage on which a user makes a golf swing with a golf club, comprising: lower supporter; a divided swing-stage provided on the lower supporter to form the swing stage including a plurality of divided plates each of which implements an inclination based on terrain information and having spacing parts each of which is formed between the adjacent divided plates; a terrain realization driver provided between the lower supporter and the divided swing-stage, and configured to drive so that each of the divided plates operates a predetermined inclination and the divided swing-stage implements a predetermined terrain by inclinations of the divided plates; and a rotating-support hub provided in the central portion of the divided swing-stage and supporting each end of the plurality of divided plates to be rotatably.

Preferably, the spacing part includes a triangular spacing part between adjacent divided plates to gradually widen the interval from the rotating-support hub to an edge.

Preferably, the swing platform further comprises a rubber supporter for elastically supporting the adjacent divided plates by fixing one end and the other end to each of the adjacent divided plates forming the spacing part.

Preferably, the swing platform further comprises a gap buffer provided at one end surface and the other end surface of the adjacent divided plates forming the triangular spacing part to buffer the adjacent divided plates according to the driving of the divided plates.

Preferably, the rotating-support hub includes: a hub shaft provided in the center of the divided swing-stage; and a rotating-support part provided on the hub shaft corresponding to each of the plurality of divided plates and supporting each of the plurality of divided plates to rotate with respect to the hub shaft around at least two axial directions.

Preferably, the divided swing-stage is configured to be divided into a first divided plate, a second divided plate, a third divided plate, and a fourth divided plate with the rotating-support hub as a center, and the rotating-support hub includes: a hub shaft provided in the center of the divided swing-stage; a first rotating-support part provided on the hub shaft corresponding to the first divided plate and supporting the first divided plate to rotate around two axes perpendicular to the central axis of the hub shaft; a second rotating-support part provided on the hub shaft corresponding to the second divided plate and supporting the second divided plate to rotate around two axes perpendicular to the central axis of the hub shaft; a third rotating-support part provided on the hub shaft corresponding to the third divided plate and supporting the third divided plate to rotate around two axes perpendicular to the central axis of the hub shaft; and a fourth rotating-support part provided on the hub shaft corresponding to the fourth divided plate and supporting the fourth divided plate to rotate around two axes perpendicular to the central axis of the hub shaft.

Preferably, the swing platform further comprises a hub driver provided in the center of the lower supporter to drive the hub shaft linearly in the vertical direction.

Preferably, the terrain realization driver is configured to include a plurality of driving actuators each of which is coupled between each of the divided plates and the lower supporter in an inclined state so that each of the divided plates implements to an inclination by extension and retraction of each of the driving actuators, wherein a position of the rotating-support part of one of the divided plates and positions of two driving actuators fixed to the corresponding divided plate form vertices of a triangle.

Preferably, the lower supporter is partitioned to a plurality of regions and the rotating-support hub is provided in a central region of the partitioned regions, wherein the terrain realization driver includes a plurality of driving actuators in each of a plurality of regions around the central region of the lower supporter, wherein lower ends of the two driving actuators are fixed to each of the regions and the two driving actuators are provided to be inclined away from each other, and wherein the upper end of the driving actuator on one region and the upper end of the driving actuator on another region are fixed to one of the divided plates, respectively, and each of the driving actuators fixed to the divided plate is driven to extend and retract in a longitudinal direction so that the corresponding divided plate enables to implement an inclination.

Preferably, the rubber supporter includes: coupling parts each of which is coupled to each of the adjacent divided plates forming the triangular spacing part, and a V-connector V-shaped and connecting the coupling parts.

Advantageous Effects

The present invention has an advantageous effect that the divided and driving swing platform enables to be operated stably by increasing a degree of freedom of movement of each of the divided plates so that each of the divided plates can move in various ways and interference between the divided plates does not occur when each of the divided plates is driven and operated.

BEST MODE

A specific description of the divided driving swing platform according to the present invention will be described with reference to the drawings.

Figure 1:
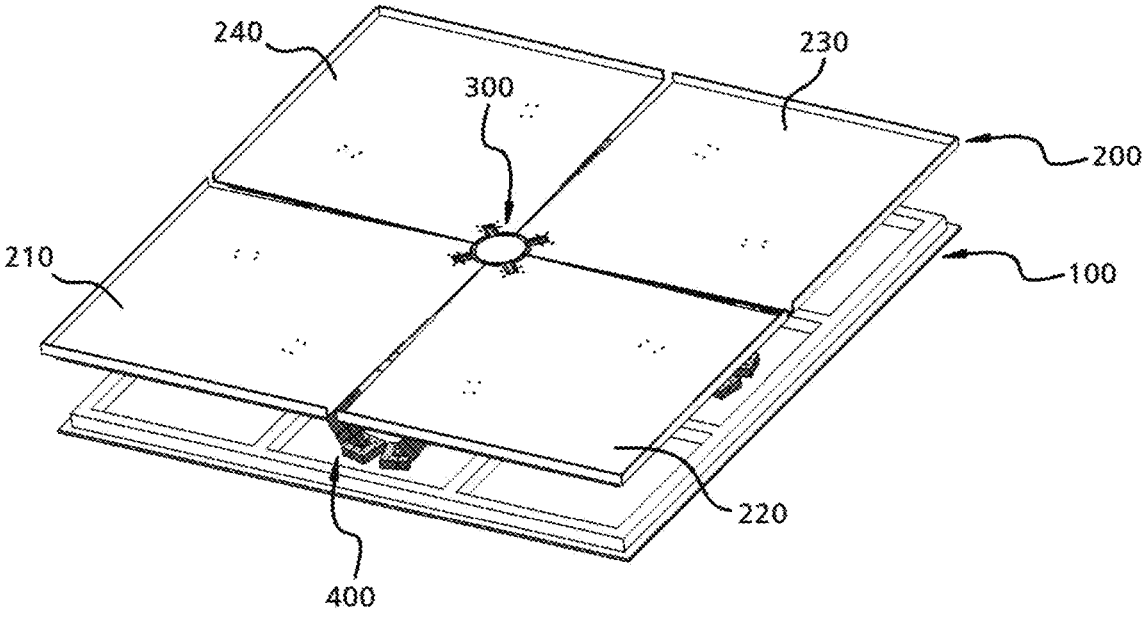
FIG. 1 is a perspective view of a swing platform according to an embodiment of the present invention.

First, the configuration of the divided driving swing platform according to an embodiment of the present invention will be described with reference to FIG. 1. FIG. 1 is a perspective view of the swing platform according to an embodiment of the present invention.

As shown in FIG. 1, the swing platform according to an embodiment of the present invention is a device for providing a swing-stage on which a user can perform a golf swing with a golf club. The swing platform includes a lower supporter 100, a divided swing-stage 200, a rotating-support hub 300, and a terrain realization driver 400.

The lower supporter 100 is an element for supporting device at the lower end of the swing platform according to an embodiment of the present invention, and may be provided on a bottom surface where the swing platform is installed, and the terrain realization driver 400 may be mounted on the upper end of the lower supporter 100.

The divided swing-stage 200 is mounted on the terrain realization driver 400 on the lower supporter 100 to provide a swing stage on which a user stands, and includes a plurality of divided plates each of which can implement inclinations based on terrain information (e.g., information on a virtual golf course implemented as an image of a virtual golf simulation system).

As shown in FIG. 1, the first divided plate 210, the second divided plate 220, the third divided plate 230 and the fourth divided plate 240 provided by dividing the entire swing-stage into quarters are implemented as the plurality of divided plates, and all of the plurality of divided plates 210~240 may form the divided swing-stage 200.

The terrain realization driver 400 is installed between the lower supporter 100 and the divided swing-stage 200, wherein the terrain realization driver 400 can drive each of the divided plates 210 to 240 to implement predetermined inclinations so that the divided swing-stage 200 can form a predetermined terrain.

The rotating support hub 300 is provided at the center of the divided swing-stage 200 to rotatably support the ends of each of the plurality of the divided plates 210 to 240.

The divided driving swing platform according to an embodiment of the present invention includes the lower supporter 100, the divided swing-stage 200, the rotating support hub 300, and the terrain realization driver 400, and may further include a controller (not shown) for controlling them. The controller may receive terrain information to be implemented by the swing platform from a client such as, for example, a simulator of a virtual golf simulation system, and control the terrain realization driver 400 based on the received terrain information to control each of the divided plates 210 to 240 to rotate individually and implement complex inclinations close to the actual terrain.

The features of the present invention as described above will be described in more detail with reference to FIGS. 2 to 4.

Figure 2:
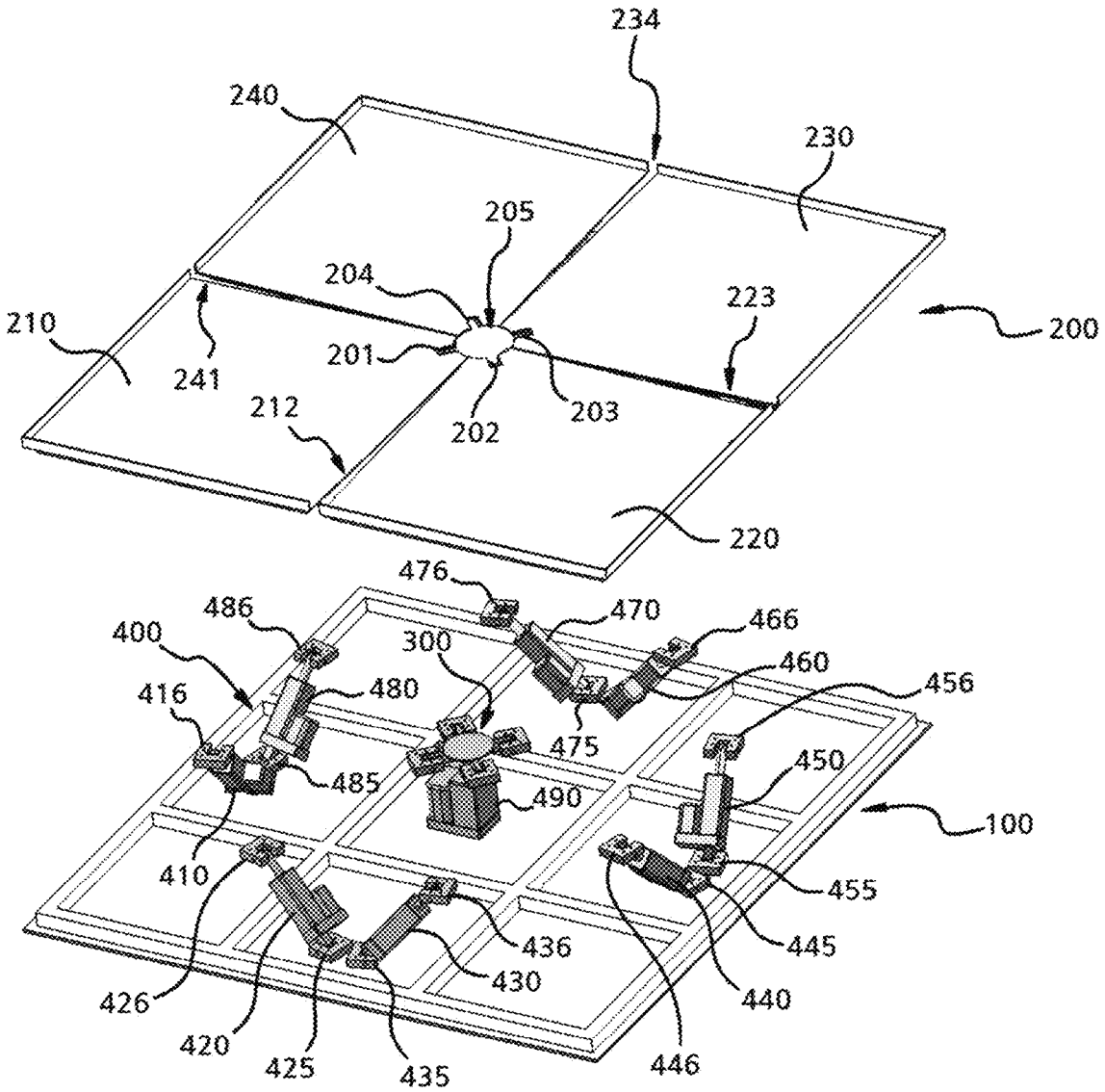
FIG. 2 is a perspective view showing a divided swing-stage separated from a lower supporter of the divided driving swing platform according to an embodiment of the present invention.

FIG. 2 is a perspective view showing a divided swing-stage separated from a lower supporter of the divided driving swing platform according to an embodiment of the present invention. FIG. 3 is a top view showing the lower supporter and a terrain realization driver shown in FIG. 2. FIG. 4 is a view showing a driving actuator and a rotating-support hub of the terrain realization driver shown in FIG. 2.

Figure 3:
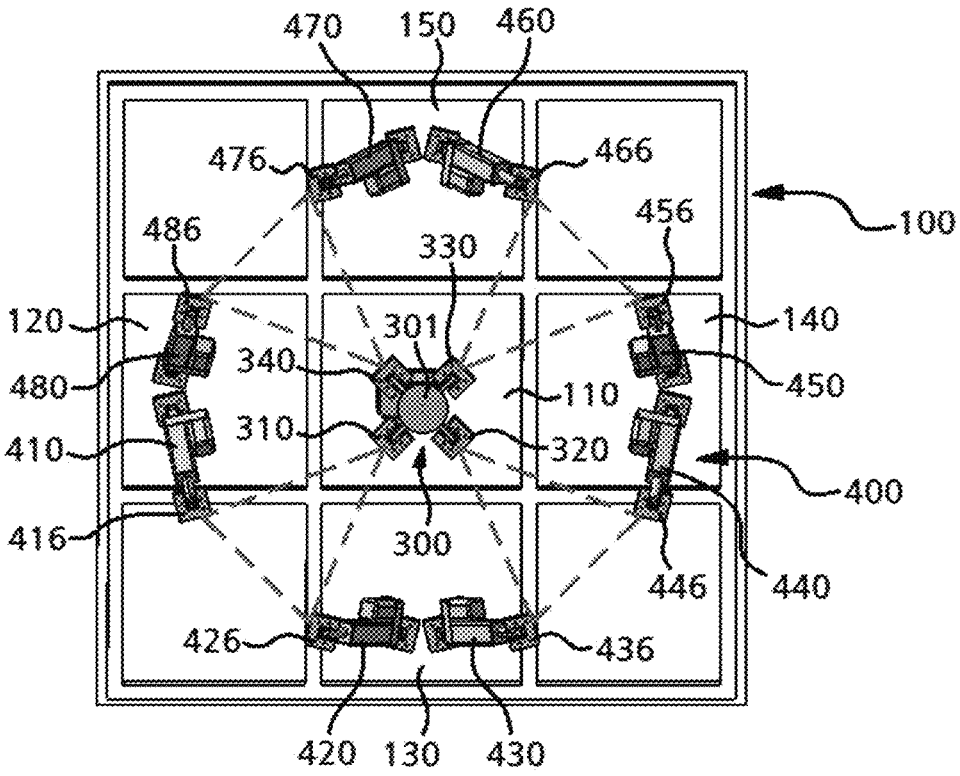
FIG. 3 is a top view showing the lower supporter and a terrain realization driver shown in FIG. 2.

As shown in FIGS. 2 and 3, the rotating support hub 300 is provided at the center of the lower supporter 100, and the hub driver 490 for vertically driving the rotating support hub 300 is provided at the center of the lower supporter 100. A plurality of driving actuators 410 to 480 may be installed around the rotating support hub 300 as the terrain realization driver 400.

The rotating support hub 300 allows each of the divided plates 210 to 240 to rotate while fixedly supporting each of the divided plates 210 to 240 at the center of the divided swing-stage 200 (the rotations of each of the divided plates includes rotation in the uniaxial direction as well as rotation in the biaxial direction, which will be described below).

The plurality of driving actuators, as shown in FIGS. 2 and 3, may include a first driving actuator 410, a second driving actuator 420, a third driving actuator 430, a fourth driving actuator 440, a fifth driving actuator 450, a sixth driving actuator 460, a seventh driving actuator 470 and an eighth driving actuator 480.

Each of the driving actuators 410 to 480 may have a lower fixing member at its lower end. As shown in FIGS. 2 and 3, a first lower fixing member (not shown) may be provided at the lower end of the first driving actuator 410, a second lower fixing member 425 may be provided at the lower end of the second driving actuator 420, a third lower fixing member 435 may be provided at the lower end of the third driving actuator 430, a fourth lower fixing member 445 may be provided at the lower end of the fourth driving actuator 440, a fifth lower fixing member 455 may be provided at the lower end of the fifth driving actuator 450, a sixth lower fixing member 465 may be provided at the lower end of the sixth driving actuator 460, a seventh lower fixing member 475 may be provided at the lower end of the seventh driving actuator 470, and a eighth lower fixing member 485 may be provided at the lower end of the eighth driving actuator 480.

Each of the lower fixing members 425 to 485 as stated above allows each of the corresponding driving actuators 410 to 480 to be rotatable while allowing each of the corresponding driving actuators 410 to 480 to be fixed on the lower supporter 100.

Meanwhile, each of the driving actuators 410 to 480 may have an upper fixing member on its upper end. As shown in FIGS. 2 and 3, a first upper fixing member 416 may be provided at the upper end of the first driving actuator 410, a second upper fixing member 426 may be provided at the upper end of the second driving actuator 420, a third upper fixing member 436 may be provided at the upper end of the third driving actuator 430, a fourth upper fixing member 446 may be provided at the upper end of the fourth driving actuator 440, a fifth upper fixing member 456 may be provided at the upper end of the fifth driving actuator 450, a sixth upper fixing member 466 may be provided at the upper end of the sixth driving actuator 460, a seventh upper fixing member 476 may be provided at the upper end of the seventh driving actuator 470, and a eighth upper fixing member 486 may be provided at the upper end of the eighth driving actuator 480.

Each of the upper fixing members 416 to 486 as stated above allows each of the corresponding driving actuators 410 to 480 to be rotatable while allowing each of the corresponding driving actuators 410 to 480 to be fixed on each of the divided plates 201 to 240 of the divided swing-stage 200.

However, as shown in FIGS. 2 and 3, each of the driving actuators 410 to 480 is fixed and driven in an oblique posture inclined in a predetermined angle from the lower fixing member to the upper fixing member, and the two driving actuators are fixed to one divided plate so that the inclination of the divided plate to be implemented by the two driving actuators.

And, as shown in FIG. 2, each of the divided plates 210 to 240 of the divided swing-stage 200 may include each of grooves 201 to 204 in the center thereof. The plurality of divided plates 210 to 240 form one installation hole 205, and the rotating support hub 300 is installed in the installation hole 205.

As shown in FIG. 3, the rotating support hub 300 may be configured to include a hub shaft 301 in the center and rotating-support part 310 to 340 corresponding to each of the plurality of divided plates 210 to 240 on the hub shaft 301.

That is, as shown in FIGS. 2 and 3, the first rotating-support part 310 of the rotating support hub 300 may be fixed to the side of the first groove 201 of the first divided plate 210, the second rotating-support part 320 of the rotating support hub 300 may be fixed to the side of the second groove 202 of the second divided plate 220, the third rotating-support part 330 of the rotating support hub 300 may be fixed to the side of the third groove 203 of the third divided plate 230, and the fourth rotating-support part 340 of the rotating support hub 300 may be fixed to the side of the fourth groove 204 of the fourth divided plate 240.

As shown in FIGS. 2 and 3, the first rotating-support part 310 of the rotating-support hub 300, the first upper fixing member 416 of the first driving actuator 410, and the second upper fixing member 426 of the second driving actuator 420 may be fixed on the first divided plate 210, respectively, so that their respective installed positions form the vertices of a triangle.

Similarly, the second rotating-support part 320 of the rotating-support hub 300, the third upper fixing member 436 of the third driving actuator 430, and the fourth upper fixing member 446 of the fourth driving actuator 440 may be fixed on the second divided plate 220, respectively, so that their respective installed positions form the vertices of a triangle. The third rotating-support part 330 of the rotating-support hub 300, the fifth upper fixing member 456 of the fifth driving actuator 450, and the sixth upper fixing member 466 of the sixth driving actuator 460 may be fixed on the third divided plate 230, respectively, so that their respective installed positions form the vertices of a triangle. The fourth rotating-support part 340 of the rotating-support hub 300, the seventh upper fixing member 476 of the seventh driving actuator 470, and the eighth upper fixing member 486 of the eighth driving actuator 480 may be fixed on the fourth divided plate 240, respectively, so that their respective installed positions form the vertices of a triangle.

As shown in FIG. 3, the terrain realization driver 400 may have a structure in which a plurality of triangles of which is connected with the position of the rotating-support part and the positions of the two driving actuators as vertices are arranged at a predetermined interval. The upper fixing member of each of the two driving actuators is fixed to a position of each of both vertices of each triangle, and the lower fixing member of each of the two driving actuators is fixed to the lower supporter 100. Wherein the lower fixing member of each of the two driving actuators is fixed to the lower supporter by being inclined in a direction away from each other. In this state, as each of the two driving actuators extends and retracts in the longitudinal direction, an inclination of the divided plate corresponding to the two driving actuators may be implemented.

As the rotating-support part and the two driving actuators support each divided plate in a triangular structure and each driving actuator is installed at both vertices of the triangle in a predetermined inclined posture from the lower supporter to the divided swing-stage, each divided plate can stably perform the operation of the inclination. And, since each driving actuator is installed in an inclined state as described above, the installation height of the swing platform can be lowered.

The configuration of the above-described terrain realization driver 400 will be described in more detail. As shown in FIGS. 2 and 3, the lower supporter 100 is partitioned to a plurality of regions 110 to 150, etc., the rotating support hub 300 is provided in the central region 110, and two driving actuators are provided in each of the plurality of regions 120 to 150 around the central region 110 of the lower supporter 100. The upper ends of the two driving actuators fixed in each region are provided inclined in a direction away from each other, and the upper end of one driving actuator in one region and the upper end of another driving actuator in another neighboring region are fixed to one divided plate. Accordingly, the inclination of the corresponding divided plate may be implemented by the longitudinal expansion and contraction driving of each of the two inclined driving actuators.

That is, as shown in FIGS. 2 and 3, the lower supporter 100 is partitioned to include the central region 110 and a plurality of regions (e.g., the first region 120, the second region 130, the third region 140, and the fourth region 150) around the central region 110. The rotating support hub 300 is fixedly installed in the central region 110. And the lower ends of the eighth driving actuator 480 and the first driving actuator 410 are installed adjacent to each other in the first region 120, the lower ends of the second driving actuator 420 and the third driving actuator 430 are installed adjacent to each other in the second region 130, the lower ends of the fourth driving actuator 440 and the fifth driving actuator 450 are installed adjacent to each other in the third region 130, and the lower ends of the sixth driving actuator 460 and the seventh driving actuator 470 are installed adjacent to each other in the fourth region 140. In such a state that each driving actuator is installed in the lower supporter 100, the first driving actuator 410 and the second driving actuator 420 are fixed to the lower surface of the first divided plate 210 in an inclined posture, the third driving actuator 430 and the fourth driving actuator 440 are fixed to the lower surface of the second divided plate 220 in an inclined posture, the fifth driving actuator 450 and the sixth driving actuator 460 are fixed to the lower surface of the third divided plate 230 in an inclined posture, and the seventh driving actuator 470 and the eighth driving actuator 480 are fixed to the lower surface of the fourth divided plate 240 in an inclined posture.

A detailed configuration of each of the driving actuators 410 to 480 and the rotating support hub 300 will be described with reference to FIG. 4. FIG. 4(*a*) is a view showing the configuration of the driving actuator, and FIG. 4(*b*) is a view showing the configuration of the rotating support hub. (In FIG. 4(*a*), drawing numbers of the first driving actuator are given, however since all the driving actuators have the same configuration, when explaining FIG. 4(*a*), the "first" part will be omitted and explained).

Figure 4:
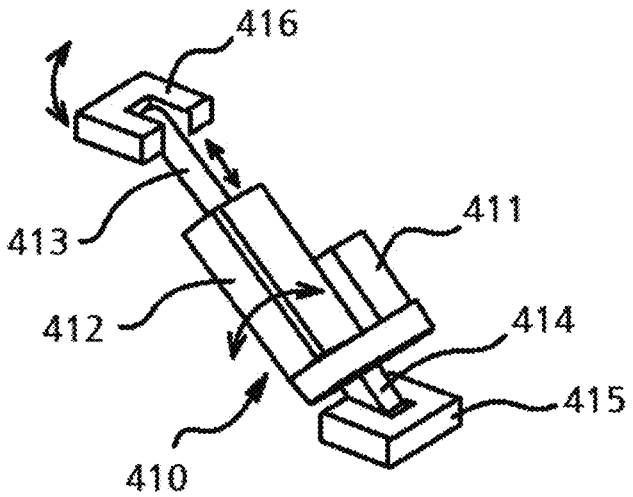
FIG. 4 is a view showing a driving actuator and a rotating-support hub of the terrain realization driver shown in FIG. 2.
Figure 4:
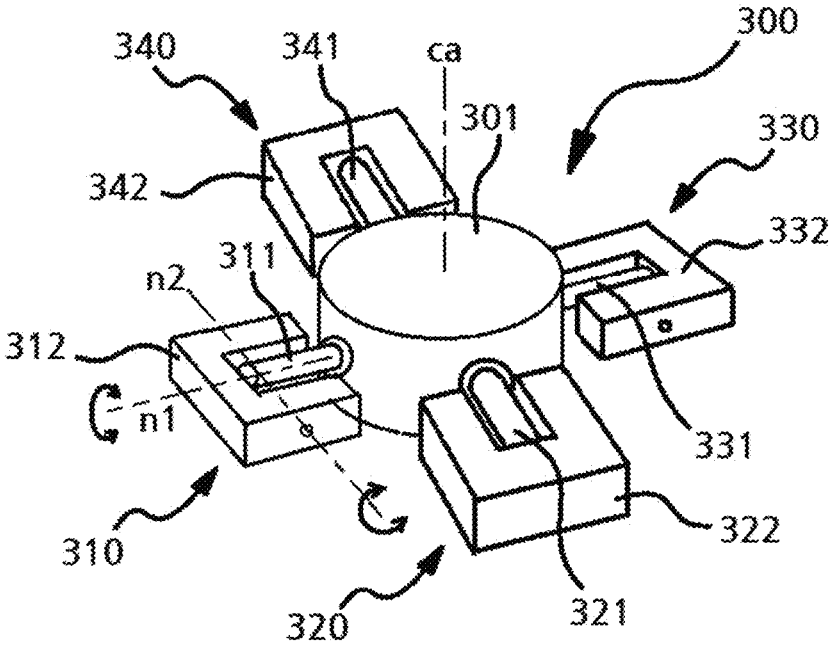

As shown in FIG. 4(*a*), the driving actuator 410 is configured to include a driving motor 411, a driving cylinder 412 operated by the driving motor 411, a rod 413 enabling to be extended and retracted in a linear direction according to the operation of the driving cylinder 412, a supporting shaft 414 protruding on the opposite side of the rod 413, a lower fixing member 415 to which the supporting shaft 414 is rotatably coupled and fixed on the lower supporter 100, and an upper fixing member 416 rotatably coupled to the rod 413 and fixed to the lower surface of the divided plate 210.

As the driving motor 411 rotates forward or reverse, the rod 413 of the driving cylinder 412 linearly moves in the longitudinal direction. As the rod 413 moves in the longitudinal direction, the driving actuator 410 rotates with respect to the lower fixing member 415 and the upper fixing member 416, respectively, and the inclination angle is changed.

As the two driving actuators 410 each operate as described above, the divided plate can implement various inclinations.

Meanwhile, as shown in FIG. 4(*b*), the rotating support hub 300 includes a hub shaft 301 provided at the center of the divided swing-stage 200. The rotating support hub 300 may further include a first rotating-support part 310 which the first divided plate 210 supports to be rotatable about two axes n1 and n2 perpendicular to the central axis ca of the hub shaft, a second rotating support part 320 which the second divided plate 220 supports to be rotatable about two axes perpendicular to the central axis ca, a third rotating support part 330 which the third divided plate 230 supports to be rotatable about two axes perpendicular to the central axis ca, and a fourth rotating support part 340 which the fourth divided plate 240 supports to be rotatable about two axes perpendicular to the central axis ca.

As shown in FIG. 4(*b*), the first rotating-support part 310 is configured to include a first rotating-support shaft 311 which is rotatably (rotation around the n1 axis) provided to the hub shaft 301, and a first rotating-support fixer 312 which is rotatably (rotation around the n2 axis) provided to the first rotating-support shaft 311 and fixed to the first groove 201 of the first divided plate 210.

The configuration of the first rotating-support part 310 is substantially the same as that of the other rotating-support parts 320 to 340. That is, the second rotating-support part 320 is configured to include a second rotating-support shaft 321 which is rotatably provided to the hub shaft 301, and a second rotating-support fixer 322 which is rotatably provided to the second rotating-support shaft 321 and fixed to the second groove 202 of the second divided plate 220. And the third rotating-support part 330 is configured to include a third rotating-support shaft 331 which is rotatably provided to the hub shaft 301, and a third rotating-support fixer 332 which is rotatably provided to the third rotating-support shaft 331 and fixed to the third groove 203 of the third divided plate 230. And the fourth rotating-support part 340 is configured to include a fourth rotating-support shaft 341 which is rotatably provided to the hub shaft 301, and a fourth rotating-support fixer 342 which is rotatably provided to the fourth rotating-support shaft 341 and fixed to the fourth groove 204 of the fourth divided plate 240.

Meanwhile, the hub shaft 301 may be driven in the vertical direction by the hub driver 490 provided at the center of the lower supporter 100 (see FIG. 2).

Accordingly, each of the rotating-support parts may be fixed to the central portion of each divided plate to support each divided plate to be rotatable about the hub shaft in two directions. In this regard, it will be described with reference to FIG. 5.

Figure 5:
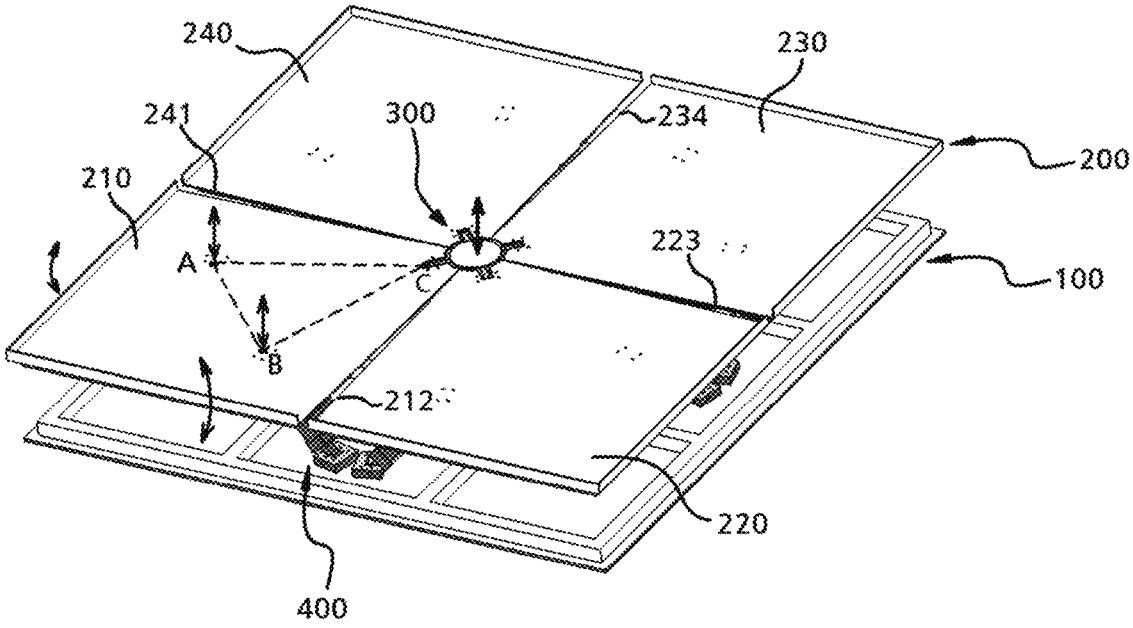
FIG. 5 is a view for explaining an operation of the divided driving swing platform according to an embodiment of the present invention.

As shown in FIG. 5, the first divided plate 210 has a support structure of a triangle connecting a support point C (a position where the first rotating-support part 310 is installed) on the side of the rotating-support hub 300, an action point A at which the upper end of the first driving actuator is fixed, and an action point B at which the upper end of the second driving actuator is fixed (This corresponds to the triangular structure that connects the first rotating-support part, the first driving actuator, and the second driving actuator shown in FIG. 3). In accordance with the operation of the first driving actuator based on the support point C, the action point A part moves up and down to implement an inclination. Or in accordance with the operation of the second driving actuator, the inclination may be implemented as the action point B moves up and down. Or an inclination may be realized by simultaneous up-and-down movement at the action points A and B. In each of the above cases, as the hub driver 490 moves the hub shaft 301 in the vertical direction and the supporting point C moves in the vertical direction with movements at each of the points A and B, various inclinations of the divided plate can be implemented.

The configuration and operation of the triangular support structure by the supporting point C, the action points A and B for the first divided plate 210 shown in FIG. 5 and the implementation of the inclination accordingly are substantially the same for other divided plates. Accordingly, the description of the other divided plates will be replaced with the description of the configuration and operation of the above stated the first divided plate, and the redundant description will be omitted.

Accordingly, the swing platform according to an embodiment of the present invention can implement various terrain by driving each of the divided plates 210 to 240 by the configuration as described above. For example, it is possible to implement a variety of terrain as shown in each of FIGS. 9(*a*) to 9(*f*).

Figure 9:
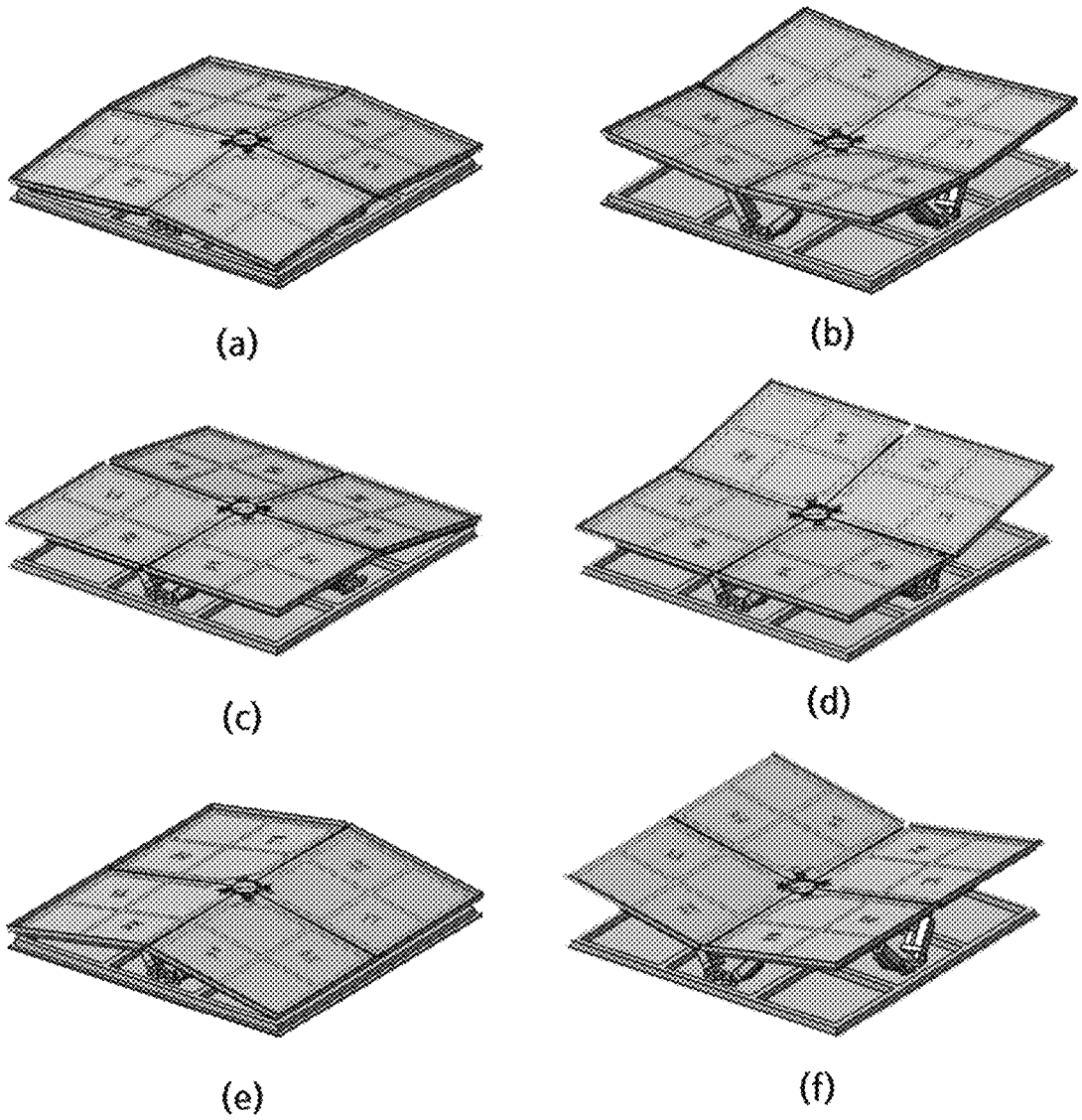
FIG. 9 is a view showing examples of various terrain realization of the swing platform according to an embodiment of the present invention.

FIG. 9 shows several examples of implementing the terrain by driving each driving actuator in a state where the rotating-support hub at the center of the divided swing-stage is not driven up and down, and the present invention is not limited thereto, and more various terrain may be implemented according to the operations of the hub driver and the terrain realization driver.

As each driving actuator operates, each divided plate is variously inclined, and in this regard, interference may occur between adjacent divided plates and damage may occur due to mechanical friction or compression between adjacent divided plates.

In order to solve the problem, the swing platform according to an embodiment of the present invention may provide a spacing part forming a predetermined interval between the plurality of divided plates of the divided swing-stage 200 to prevent interference between adjacent divided plates during an operation of the divided swing-stage.

Such the spacing part may be provided in various forms. For example, the spacing part may be simply provided to form the same interval in a straight shape, or may be provided to form the interval in a curved shape, or may be provided in a configuration in which the interval increases further from the center.

Among the various types of the spacing parts, in the present specification, a configuration in which the distance from the center is increased is referred to as a triangular spacing part, and a configuration in which the triangular spacing part is included will be described.

However, the above spacing part according to the present invention may include not only a triangular spacing part but also all spacing parts of any shape.

Figure 6:
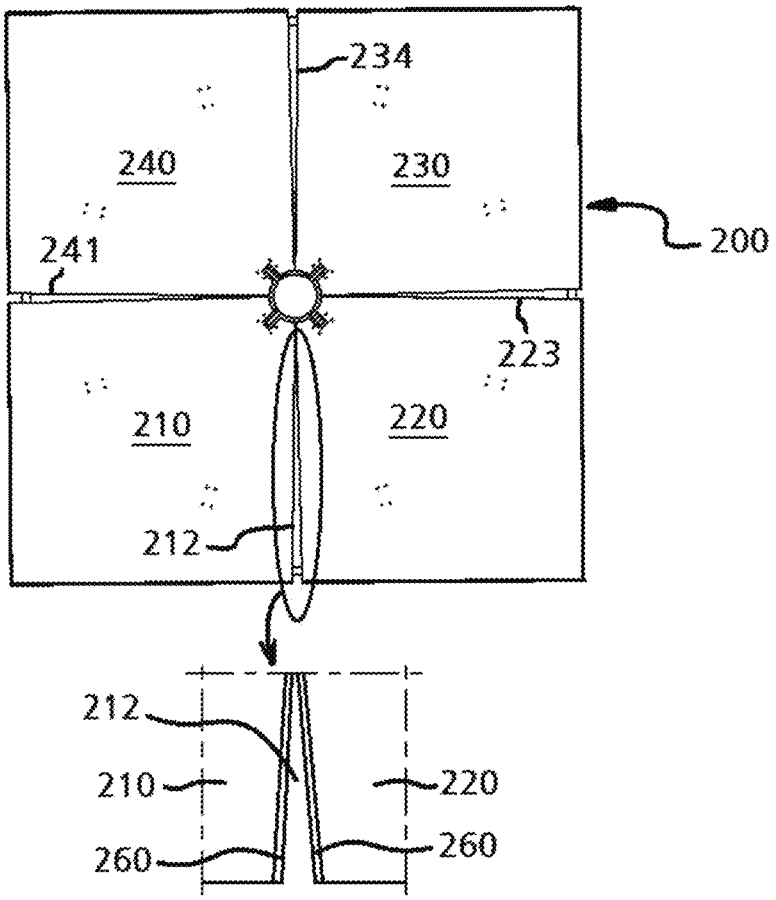
FIG. 6 is a view for explaining a triangular spacing part applied to the divided driving swing platform according to an embodiment of the present invention.

In detail, as shown in FIGS. 2, 5, and 6, the swing platform according to an embodiment of the present invention has a feature that the triangular spacing parts 212, 223, 234, and 241 spaced apart from each other to be farther from the rotating-support hub 300 are formed between adjacent divided plates.

That is, as shown in FIGS. 5 and 6, the first triangular spacing part 212 may be formed between the first divided plate 210 and the second divided plate 220 such that the adjacent surface of the first divided plate 210 and the adjacent surface of the second divided plate 220 gradually widen away from the center part. And the second triangular spacing part 223 may be formed between the second divided plate 220 and the third divided plate 230 such that the adjacent surface of the second divided plate 220 and the adjacent surface of the third divided plate 230 gradually widen away from the center part. And the third triangular spacing part 234 may be formed between the third divided plate 230 and the fourth divided plate 240 such that the adjacent surface of the third divided plate 230 and the adjacent surface of the fourth divided plate 240 gradually widen away from the center part. And the fourth triangular spacing part 241 may be formed between the fourth divided plate 240 and the first divided plate 210 such that the adjacent surface of the fourth divided plate 240 and the adjacent surface of the first divided plate 210 gradually widen away from the center part.

As described above, the triangular spacing parts 212, 223, 234, and 241 are formed between the divided plates 210 to 240, thereby preventing a phenomenon in which two adjacent divided plates move and interfere with each other, thereby providing a swing platform capable of implementing a terrain in a stable and reliable operation.

However, even when the triangular spacing part is formed due to an operation error due to a long-term use of the swing platform or expansion of a material according to surrounding temperature conditions, friction may occur between the two divided plates.

In order to prevent noise due to friction between the two divided plates or deformation at adjacent surfaces, the swing platform according to an embodiment of the present invention may include a gap buffer 260 at one end surface and the other end surface of the adjacent divided plates 210 and 220 as shown in FIG. 6. The gap buffer 260 may be buffered between adjacent divided plates according to the driving of each divided plate.

The gap buffer 260 may be provided to one end surface and the other end surface of each of the divided plates by various methods such as bonding, fastening, or covering a cover of a buffer material on the divided plates.

Meanwhile, in the swing platform according to the present invention, the divided swing-stage 200 is configured to include a plurality of divided plates 210 to 240 and each of the divided plates is individually driven to form an inclination, and the two divided plates are spaced apart by the triangular spacing part 212 as described above. Therefore, there may be a problem in which the two divided plates are slightly misaligned from each other. (For example, if a larger load is added to one divided plate, a slight deviation may occur, and an operation error may also cause the deviation.)

Figure 7:
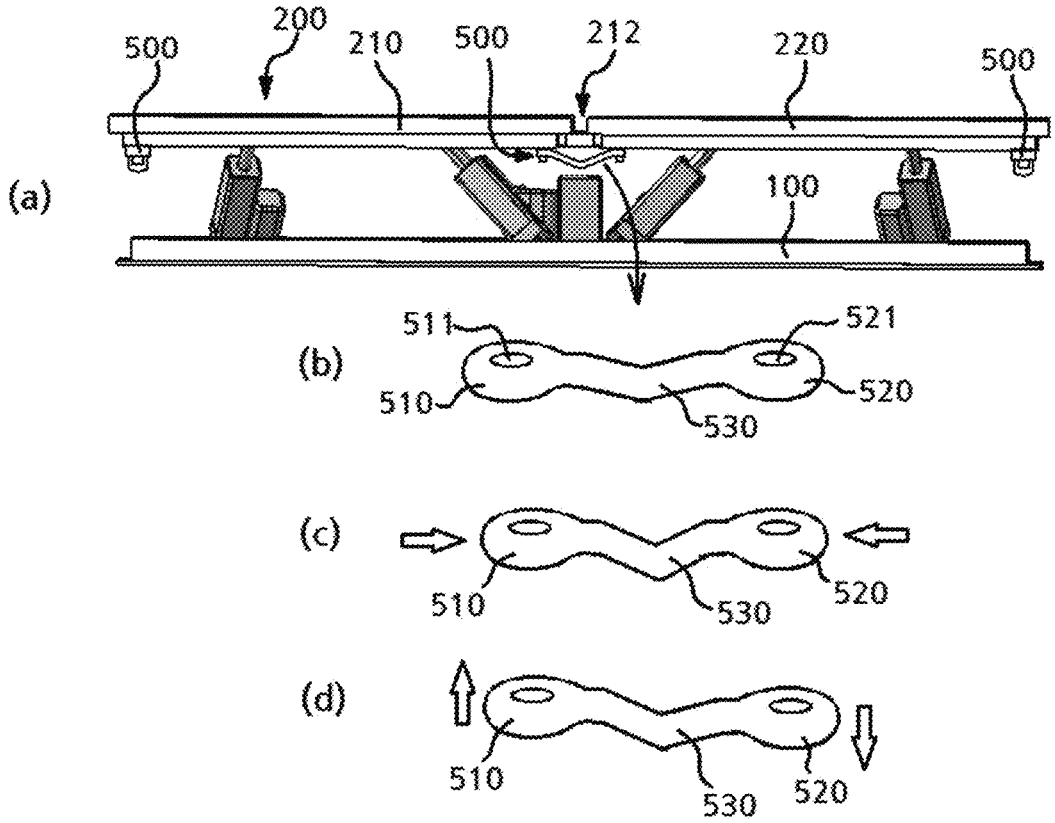
FIG. 7 shows (a) a side view of the swing platform shown in FIG. 6, and (b) to (d) views showing a structure and an operation of a rubber supporter applied to the divided driving swing platform according to an embodiment of the present invention.

In order to solve this problem, as shown in FIG. 7(*a*), the present invention may include a rubber supporter 500 that elastically supports two adjacent divided plates 210 and 220 by fixing one end and the other end thereof to each of the adjacent divided plates 210 and 220.

It is also possible to think of a method of elastically supporting the triangular spacing part of two adjacent divided plates with a coil spring or the like. However, since each of the divided plates has various inclinations in the process of implementing the terrain of the divided plate, various forces such as compression and elongation are applied between two adjacent divided plates, and thus, a rubber member as the rubber supporter may be provided to effectively support various forces.

In particular, the swing platform according to an embodiment of the present invention includes a rubber member having a structure bent at a predetermined angle as the rubber supporter as shown in FIGS. 7(*a*) and 7(*b*), thereby more effectively supporting various forces generated between two adjacent divided plates.

As shown in FIGS. 7(*a*) and 7(*b*), the rubber supporter 500 may include coupling parts 510 and 520 coupled to each of the adjacent divided plates 210 and 220 forming the triangular spacing part 212, and a V-shaped V-connector 530 connecting the coupling parts 510 and 520.

Fastening holes 511 and 521 may be formed at both ends of the rubber supporter 500 to insert bolts, and the rubber supporter 500 is fixed under the triangular spacing part 212 by the bolts, thereby easily replacing the rubber supporter 500.

As shown in FIG. 7(*b*), since the rubber supporter 500 includes the V-connector 530, when various forces are applied to the rubber supporter 500, the V-connector 530 may be deformed more freely than just a cylindrical or prismatic rubber member, thereby providing more effective elastic support.

For example, as shown in FIG. 7(*c*), when compressive force or tensile force is applied to both sides of the rubber supporter 500 according to the operation of the two divided plates, the shape of the V-connector 530 as well as the elastic force of rubber material may be more freely deformed.

As shown in FIG. 7(*d*), even when distortion on the rubber supporter 500 by forces applied to both sides in the opposite direction, it can be deformed by the V-connector 530 to support elasticity. Accordingly, the rubber supporter 500 as shown in FIG. 7 has a structure capable of providing more effective elastic support.

Figure 8:
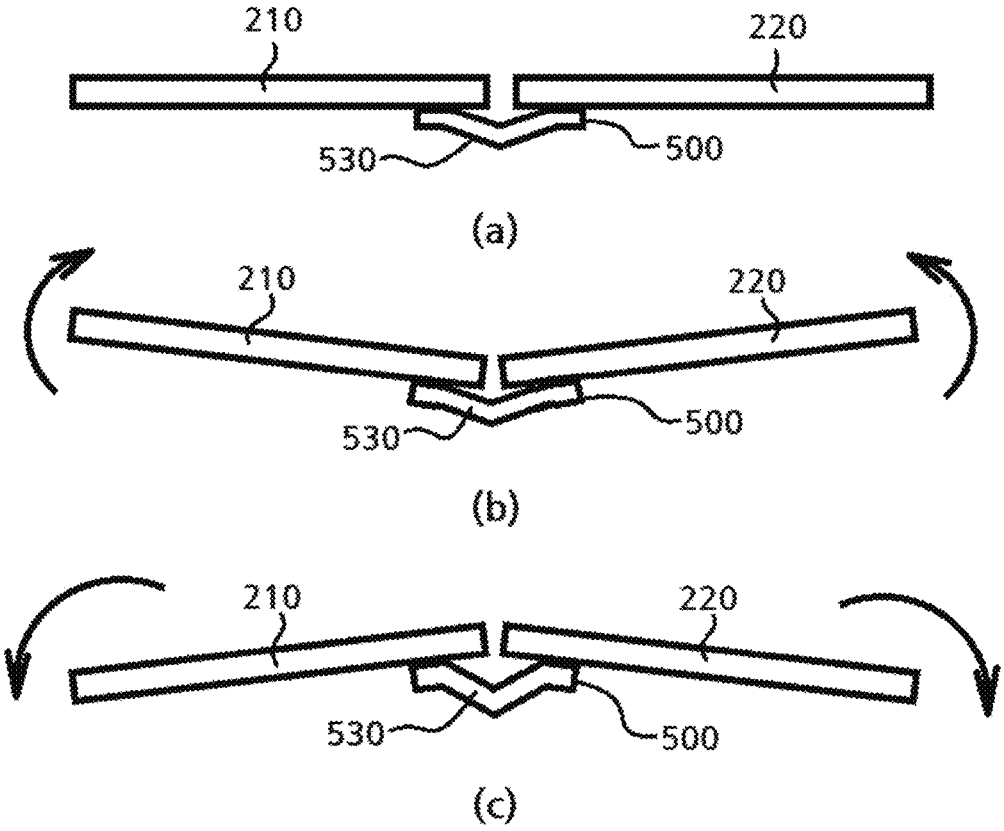
FIG. 8 is a view showing an operation and an effect of the rubber supporter applied to the divided driving swing platform according to an embodiment of the present invention.

In this regard, an effect of the rubber supporter 500 having the V-connector 530 as stated above will be more specifically described with reference to FIG. 8. As shown in FIG. 8(*a*), the rubber supporter 500 is fixed to the first divided plate 210 and the second divided plate 220 and has the V-connector 530. As shown in FIG. 8(*b*), the first divided plate 210 and the second divided plate 220 may be operated to rotate both outer ends upward or rotate both inner ends downward, thereby being inclined in a V-shape when viewed from a side surface.

When the division plates 210 and 220 are operated in the shape illustrated in FIG. 8(*b*), assuming that the straight rubber member is provided, the straight rubber member may interfere with an operation in which the divided plates 210 and 220 are rotated or acts as a load, and the rubber member may be easily damaged.

However, in the case of the rubber supporter 500 having the V-connector 530, the divided plates 210 and 220 may be naturally operated by the V-connector 530 or may be stably supported as shown in FIG. 8(*b*).

On the other hand, as shown in FIG. 8(*c*), if the divided plates 210 and 220 are inclined in a ∧-shape when viewed from the side, assuming that the straight rubber member are connected, there is a problem that the straight rubber member acts as a large load when the respective divided plates 210 and 220 rotate as shown in FIG. 8(*c*), and the rubber member may be easily damaged.

However, as shown in FIG. 8(*c*), in the case of the rubber supporter 500 having the V-connector 530, even when the V-connector 530 has the same elasticity as a simple flat-headed shape, since the V-connector 530 may be more easily closed due to shape characteristics, the rubber supporter may naturally operate without interfering with the operations of the divided plates 210 and 220 or acting as a load, and may stably support elasticity.

As described above, the divided driving swing platform according to the present invention may increase freedom and stably drive the divided plates, and may prevent interference or friction between the divided plates when the divided plates are inclined, respectively. In addition, there is an advantage of enabling reliable driving and operation by installing the rubber supporter at each triangular spacing part of the divided swing-stage.

Since the number of the divided plates, driving actuators, etc. described in the above-described embodiment of the present invention is only an example, the number is not limited to the above-described number, and the number of specific components included in the technical idea of the present invention may be added or subtracted as necessary.

All documents including public documents, patent applications, patents, and the like cited in the present invention may be merged into the present invention in the same manner as those shown in individual and specific combinations or in the present invention.

For the understanding of the present invention, reference signs have been described in the preferred embodiments shown in the drawings, and specific terms are used to describe the embodiments of the present invention, but the present invention is not limited by the specific terms, and the present invention may include all components commonly conceivable by those skilled in the art.

The use of all examples or exemplary terms (eg, etc.) in the present invention is merely for the purpose of describing the present invention in detail, and the scope of the present invention is limited by the examples or exemplary terms unless defined by the claims. In addition, those skilled in the art will recognize that various modifications, combinations, and changes may be made in accordance with design conditions and factors within the scope of the claims or their equivalents.

INDUSTRIAL APPLICABILITY

The divided driving swing platform according to the present invention may be used in an industrial field related to golf practice and a so-called screen golf industry field in which golf play may be enjoyed based on a virtual golf simulation.

The invention claimed is:

1. A divided driving swing platform providing a swing stage on which a user makes a golf swing with a golf club, comprising:

lower supporter;

a divided swing-stage provided on the lower supporter to form the swing stage including a plurality of divided plates each of which implements an inclination based on terrain information and having spacing parts each of which is formed between the adjacent divided plates;

a terrain realization driver provided between the lower supporter and the divided swing-stage, and configured to drive so that each of the divided plates operates a predetermined inclination and the divided swing-stage implements a predetermined terrain by inclinations of the divided plates;

a rotating-support hub provided in the central portion of the divided swing-stage and supporting each end of the plurality of divided plates to be rotatably; and a rubber supporter for elastically supporting the adjacent divided plates by fixing one end and the other end to each of the adjacent divided plates forming the spacing part.

2. The swing platform according to claim 1, wherein the spacing part includes a triangular spacing part between adjacent divided plates to gradually widen the interval from the rotating-support hub to an edge.

3. The swing platform according to claim 2, further comprising a gap buffer provided at one end surface and the other end surface of the adjacent divided plates forming the triangular spacing part to buffer the adjacent divided plates according to the driving of the divided plates.

4. The swing platform according to claim 1, wherein the rotating-support hub includes:

a hub shaft provided in the center of the divided swing-stage; and a rotating-support part provided on the hub shaft corresponding to each of the plurality of divided plates and supporting each of the plurality of divided plates to rotate with respect to the hub shaft around at least two axial directions.

5. The swing platform according to claim 4, further comprising a hub driver provided in the center of the lower supporter to drive the hub shaft linearly in the vertical direction.

6. The swing platform according to claim 4, wherein the terrain realization driver is configured to include a plurality of driving actuators each of which is coupled between each of the divided plates and the lower supporter in an inclined state so that each of the divided plates implements to an inclination by extension and retraction of each of the driving actuators, wherein a position of the rotating-support part of one of the divided plates and positions of two driving actuators fixed to the corresponding divided plate form vertices of a triangle.

7. The swing platform according to claim 4, wherein the lower supporter is partitioned to a plurality of regions and the rotating-support hub is provided in a central region of the partitioned regions, wherein the terrain realization driver includes a plurality of driving actuators in each of a plurality of regions around the central region of the lower supporter, wherein lower ends of the two driving actuators are fixed to each of the regions and the two driving actuators are provided to be inclined away from each other, and wherein the upper end of the driving actuator on one region and the upper end of the driving actuator on another region are fixed to one of the divided plates, respectively, and each of the driving actuators fixed to the divided plate is driven to extend and retract in a longitudinal direction so that the corresponding divided plate enables to implement an inclination.

8. The swing platform according to claim 1, wherein the rubber supporter includes:

coupling parts each of which is coupled to each of the adjacent divided plates forming the triangular spacing part, and a V-connector V-shaped and connecting the coupling parts.

9. A divided driving swing platform providing a swing stage on which a user makes a golf swing with a golf club, comprising:

lower supporter;

a divided swing-stage provided on the lower supporter to form the swing stage including a plurality of divided plates each of which implements an inclination based on terrain information and having spacing parts each of which is formed between the adjacent divided plates;

a terrain realization driver provided between the lower supporter and the divided swing-stage, and configured to drive so that each of the divided plates operates a predetermined inclination and the divided swing-stage implements a predetermined terrain by inclinations of the divided plates; and a rotating-support hub provided in the central portion of the divided swing-stage and supporting each end of the plurality of divided plates to be rotatably, wherein the divided swing-stage is configured to be divided into a first divided plate, a second divided plate, a third divided plate, and a fourth divided plate with the rotating-support hub as a center, and the rotating-support hub includes:

a hub shaft provided in the center of the divided swing-stage;

a first rotating-support part provided on the hub shaft corresponding to the first divided plate and supporting the first divided plate to rotate around two axes perpendicular to the central axis of the hub shaft;

a second rotating-support part provided on the hub shaft corresponding to the second divided plate and supporting the second divided plate to rotate around two axes perpendicular to the central axis of the hub shaft;

a third rotating-support part provided on the hub shaft corresponding to the third divided plate and supporting the third divided plate to rotate around two axes perpendicular to the central axis of the hub shaft; and a fourth rotating-support part provided on the hub shaft corresponding to the fourth divided plate and supporting the fourth divided plate to rotate around two axes perpendicular to the central axis of the hub shaft.

* * * * *